US011513464B2

(12) United States Patent
Shimizu et al.

(10) Patent No.: US 11,513,464 B2
(45) Date of Patent: Nov. 29, 2022

(54) IMAGE FORMING APPARATUS HAVING AN APPARATUS BODY AND A DETACHABLE UNIT INCLUDING A ROTARY BODY AND DRIVE GEAR

(71) Applicants: Yasunobu Shimizu, Kanagawa (JP); Hiroshi Hosokawa, Kanagawa (JP); Hiroshi Fujiwara, Kanagawa (JP); Kazuki Matsumoto, Kanagawa (JP)

(72) Inventors: Yasunobu Shimizu, Kanagawa (JP); Hiroshi Hosokawa, Kanagawa (JP); Hiroshi Fujiwara, Kanagawa (JP); Kazuki Matsumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/475,348

(22) Filed: Sep. 15, 2021

(65) Prior Publication Data

US 2022/0091556 A1 Mar. 24, 2022

(30) Foreign Application Priority Data

Sep. 18, 2020 (JP) ..... JP2020-157266

(51) Int. Cl.
*G03G 15/08* (2006.01)
*G03G 21/16* (2006.01)

(52) U.S. Cl.
CPC ..... *G03G 21/1647* (2013.01); *G03G 15/0891* (2013.01); *G03G 21/1676* (2013.01)

(58) Field of Classification Search
CPC ..... G03G 15/0891; G03G 21/1647; G03G 21/1676; G03G 21/1853; G03G 21/1857
See application file for complete search history.

(56) References Cited

U.S. PATENT DOCUMENTS

2013/0266347 A1 10/2013 Kubota et al.
2015/0234324 A1 8/2015 Harada et al.
2016/0274526 A1* 9/2016 Ochi ..... G03G 21/1864
2017/0031310 A1 2/2017 Kichise et al.
(Continued)

FOREIGN PATENT DOCUMENTS

JP 8-328449 12/1996
JP 10-078736 3/1998
(Continued)

*Primary Examiner* — Sophia S Chen
(74) *Attorney, Agent, or Firm* — Xsensus LLP

(57) ABSTRACT

An image forming apparatus includes an apparatus body and a detachable unit to be attached to the apparatus body in an attachment direction and detached from the apparatus body in a detachment direction. The detachable unit includes a rotary body and a unit drive gear. The apparatus body includes an apparatus-body drive gear to engage with the unit drive gear of the detachable unit attached in the apparatus body, at an engageable position on a downstream side of the apparatus-body drive gear in the attachment direction. One or each of the unit drive gear and the apparatus-body drive gear moves to a retracted position at which the one or each of the unit drive gear and the apparatus-body drive gear does not engage with the other of the unit drive gear and the apparatus-body drive gear and does not interfere with attachment and detachment operations of the detachable unit.

15 Claims, 8 Drawing Sheets

(56) References Cited

U.S. PATENT DOCUMENTS

| | | | | |
|---|---|---|---|---|
| 2018/0074437 | A1* | 3/2018 | Mizutani ..... | G03G 15/0856 |
| 2018/0356748 | A1 | 12/2018 | Matsumoto et al. | |
| 2018/0364620 | A1 | 12/2018 | Kubota et al. | |

FOREIGN PATENT DOCUMENTS

| | | |
|---|---|---|
| JP | 10-153940 | 6/1998 |
| JP | 2005-055631 | 3/2005 |
| JP | 2001-193370 | 8/2007 |
| JP | 2013-047776 | 3/2013 |
| JP | 2014-134660 | 7/2014 |

* cited by examiner

IMAGE FORMING APPARATUS HAVING AN APPARATUS BODY AND A DETACHABLE UNIT INCLUDING A ROTARY BODY AND DRIVE GEAR

CROSS-REFERENCE TO RELATED APPLICATION

This patent application is based on and claims priority pursuant to 35 U.S.C. § 119(a) to Japanese Patent Application No. 2020-157266, filed on Sep. 18, 2020, in the japan Patent Office, the entire disclosure of which is incorporated by reference herein.

BACKGROUND

Technical Field

Embodiments of the present disclosure relate to an image forming apparatus such as a copying machine, a printer, a facsimile machine, or a multifunction peripheral thereof or a printing machine.

Discussion of the Background Art

Conventionally, there has been known an image forming apparatus such as a copying machine or a printer in which a detachable unit such as a process cartridge or a toner container is detachably (replaceably) installed.

On the other hand, a technology has been known in which, when a process cartridge (detachable unit) is attached to an apparatus body of an image forming apparatus, a recessed portion at the center of a gear to which drive is transmitted from a motor of the apparatus body and a protrusion formed on a shalt of a photoconductor drum are moved in a longitudinal direction to be engaged with each other.

SUMMARY

According to an embodiment of the present disclosure, there is provided an image forming apparatus that includes an apparatus body and a detachable unit to be attached to the apparatus body in an attachment direction and detached from the apparatus body in a detachment direction. The detachable unit includes a rotary body and a unit drive gear to transmit a driving force to the rotary body. The apparatus body includes an apparatus-body drive gear to engage with the unit drive gear of the detachable unit attached in the apparatus body, at an engageable position on a downstream side of the apparatus-body drive gear in the attachment direction. One or each of the unit drive gear and the apparatus-body drive gear moves to a retracted position at which the one or each of the unit drive gear and the apparatus-body drive gear does not engage with the other of the unit drive gear and the apparatus-body drive gear and does not interfere with an attachment operation and a detachment operation of the detachable unit with respect to the apparatus body.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
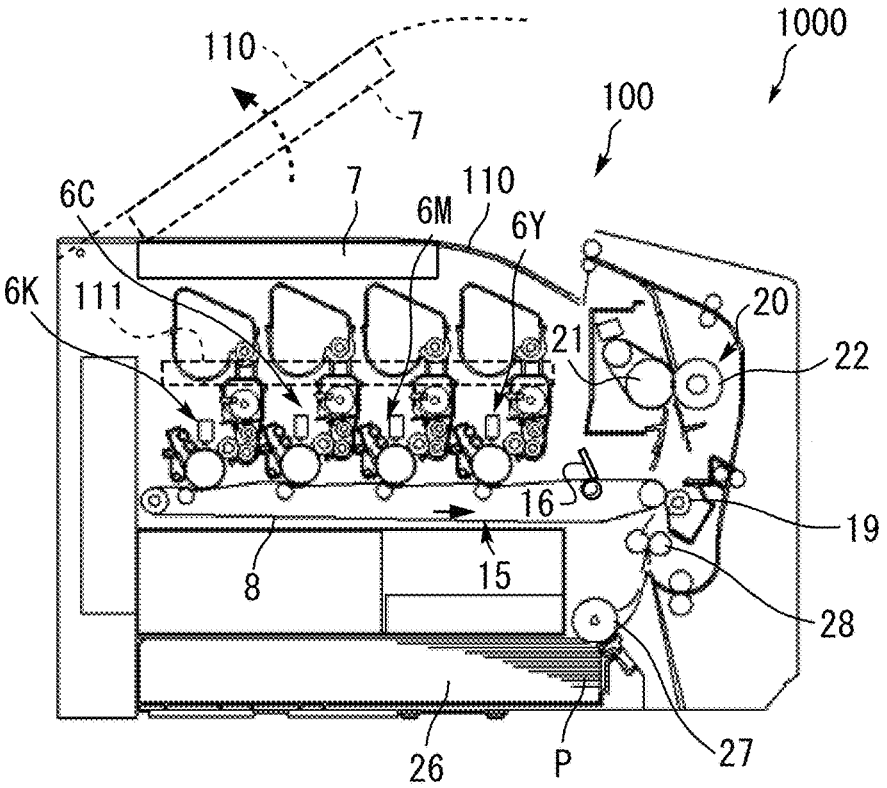
FIG. 1 is a schematic view illustrating the overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present disclosure are described below with reference to drawings. Note that identical reference numerals are assigned to identical or equivalent components and a description of those components may be simplified or omitted.

Figure 2:
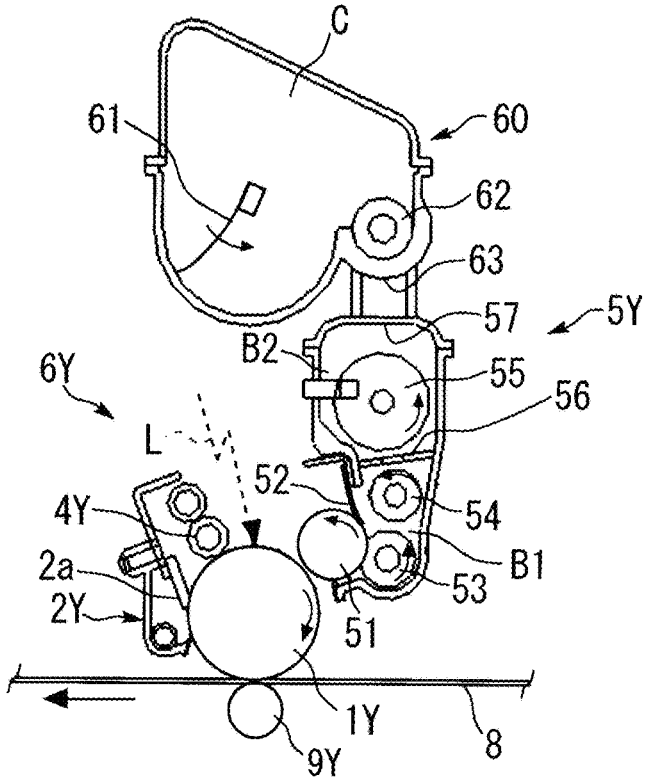
FIG. 2 is a cross-sectional view of an image forming device in the image forming apparatus of FIG. 1.

Initially with reference to FIGS. 1 and 2, a description is given of the overall configuration and operation of an image forming apparatus 1000 according to an embodiment of the present disclosure.

As illustrated in FIG. 1, an intermediate transfer belt device 15 is disposed in the middle of an apparatus body 100 of an image forming apparatus 1000. Process cartridges 6Y, 6M, 6C, and 6K corresponding to different colors of yellow, magenta, cyan, and black, respectively, are arranged in parallel to face an intermediate transfer belt 8 of the intermediate transfer belt device 15.

As illustrated in FIG. 2, the process cartridge (Y corresponding to yellow includes a photoconductor drum 1Y serving as an image bearer, and a charging device 4Y, a developing device 51, a cleaning device 21, and a charge neutralizer disposed around the photoconductor drum 1Y, which are detachable (replaceable) from the apparatus body 100 of the image forming apparatus 1000 as one unit. A series of image forming processes including charging, exposure, developing, primary transfer, cleaning, and charge neutralizing processes is performed on the photoconductor 1Y. Accordingly, a yellow toner image is formed on the surface of the photoconductor 1Y. The process cartridge 6Y and a primary transfer roller 9Y (a transfer device) together serve as an image forming device.

Note that other process cartridges 6M, 6C, and 6K serving as image forming devices have a similar configuration to that of the yellow process cartridge 6Y except the color of the toner used therein and form magenta, cyan, and black toner images, respectively. Thus, only the process cartridge 61 is described below and descriptions of other process cartridges 6M, 6C, and 6K are omitted.

Referring to FIG. 2, the photoconductor drum 1Y (image bearer) is rotated clockwise by a drive motor. At a position where the photoconductor drum 1Y opposes the charging device 4Y (e.g., a charging roller), the charging device 4Y uniformly charges the surface of the photoconductor drum 1Y (a charging process).

When the surface of the photoconductor drum 1Y reaches a position at which the surface of the photoconductor drum 1Y is irradiated with exposure light L emitted from the exposure device 7 (see FIG. 1), the photoconductor drum 1Y is scanned with the exposure light L. Thus, an electrostatic latent image corresponding to yellow is formed on the photoconductor drum 1Y (an exposure process).

When the surface of the photoconductor drum 1Y reaches a position facing the developing device 5Y, the electrostatic latent image is developed with toner into a yellow toner image (a development process).

When the surface of the photoconductor drum 1Y bearing the toner image reaches position facing a primary transfer roller 9Y via the intermediate transfer belt 8, the toner image on the photoconductor drum 1Y is transferred onto the intermediate transfer belt 8 (a primary transfer process). After the primary transfer process, a slight amount of untransferred toner remains on the photoconductor drum 1Y.

When the surface of the photoconductor drum 1Y reaches a position facing the cleaning device 2Y, a cleaning blade 2*a* collects the untransferred toner from the photoconductor drum 1Y into the cleaning device 2Y (a cleaning process).

Finally, the surface of the photoconductor drum 1Y reaches a position facing the charge neutralizer, and the charge neutralizer removes residual potentials from the photoconductor drum 1Y Thus, a series of image forming processes performed on the surface of the photoconductor drum 1Y is completed.

The above-described image forming processes are performed in the process cartridges 6M, 6C, and 6K similarly to the yellow process cartridge 6Y (serving as the image forming device). That is, exposure light based on image data is emitted from the exposure device 7 disposed above the image forming apparatus 1000 onto the photoconductor drums of the process cartridges 6M, 6C, and 6K.

Then, toner images formed on the photoconductor drums (photoconductive drum 1Y being shown in FIG. 2) through the development step are transferred and superimposed onto the intermediate transfer belt 8. Thus, a color toner image is formed on the intermediate transfer belt 8.

As illustrated in FIG. 1, the intermediate transfer belt device 15 includes, for example, the intermediate transfer belt 8, four primary transfer rollers 9 (see, e.g., the primary transfer roller 9Y in FIG. 2), a driving roller, and a driven roller. The intermediate transfer belt 8 is stretched and supported by the driving roller, the driven roller, and the primary transfer rollers and is endlessly moved in a direction indicated by an arrow (counterclockwise direction) in FIG. 1 by rotational driving of the driving roller.

The primary transfer roller 9Y nips the intermediate transfer belt 8 with the photoconductor drum 1Y to form a primary transfer nip. A transfer voltage (a primary transfer bias) opposite in polarity to toner is applied to the primary transfer roller 9Y.

The intermediate transfer belt 8 travels in the direction indicated by the arrow in FIG. 1 and sequentially passes through the primary transfer nips of the primary transfer rollers (including the primary transfer roller 9Y). Accordingly, the toner images of the respective colors on the photoconductor drums 1 (including the photoconductor cheerer 1Y) are primarily transferred and superimposed one on another onto the intermediate transfer belt 8.

Then, the intermediate transfer belt 8 onto which the toner images of the respective colors are transferred in a superimposed manner reaches a position facing the secondary transfer roller 19 (a secondary transfer device). At this position, the intermediate transfer belt 8 is nipped between the driving roller (as a secondary transfer counter roller) and the secondary transfer roller 19 to form a secondary transfer nip. The toner images of four colors formed on the intermediate transfer belt 8 are transferred onto a sheet P such as a sheet of paper conveyed to the position of the secondary transfer nip (a secondary transfer process). At this time, untransferred toner that has not been transferred onto the sheet P remains on the surface of the intermediate transfer belt 8.

The surface of the intermediate transfer belt 8 reaches the position of the intermediate transfer cleaning device 16 (e.g., an intermediate transfer cleaning blade). At this position, the untransferred toner on the intermediate transfer belt 8 is mechanically removed by the intermediate transfer cleaning blade (e.g., the intermediate transfer cleaning device 16) pressed against the intermediate transfer belt 8. The intermediate transfer cleaning blade is made of an elastic material such as urethane rubber and shaped like a plate. The intermediate transfer cleaning blade is pressed against the intermediate transfer belt 8 with a predetermined pressure and at a predetermined angle.

Thus, a series of transfer processes performed on the intermediate transfer belt is completed.

Referring to FIG. 1, the sheet. P conveyed to the position of the secondary transfer trip is conveyed from a sheet feeding device 26 disposed below the apparatus body 100 via, for example, a sheet feeding roller 27 and a registration roller pair 28 (timing roller pair).

Specifically, the sheet feeding device 26 contains a stack of multiple sheets P such as sheets of paper stacked on one on another. As the sheet feeding roller 27 rotates counterclockwise in FIG. 1, the sheet feeding roller 27 feeds an uppermost sheet P in the sheet feeding device 26 to a roller nip between the registration roller pair 28.

As the registration roller pair 28 stops rotating temporarily, the leading end of the sheet P stops moving at the roller nip of the registration roller pair 28. Rotation of the registration roller pair 28 is timed to convey the sheet P toward the secondary transfer nip such that the sheet P meets the color toner image on the intermediate transfer belt 8 at the secondary transfer nip. Thus, the desired color image is transferred onto the sheet P.

Subsequently, the sheet P, onto which the color image has been transferred at the secondary transfer nip, is conveyed to the position (fixing nip) of a fixing device 20. At this position, the color image (toner image) transferred onto the surface of the sheet P is fixed onto the sheet P by heat and pressure from the fixing belt 21 (fixing member) and the pressure roller 22 (pressure member) (a fixing step).

Thereafter, an ejection roller pair ejects the sheet P to the outside of the image forming apparatus 1000. The sheet P ejected to the outside of the image forming apparatus 1000 by the ejection roller pair is sequentially stacked on a stack portion (e.g., an operable cover 10) as an output image.

Thus, a series of image forming processes performed by the image forming apparatus 1000 is completed.

Next, image forming devices in the image forming apparatus are described in detail below with reference to FIG. 2.

As illustrated in FIG. 2, the process cartridge 6Y includes, for example, the photoconductor drum 1Y (image bearer), the charging device 4Y (charging roller), the developing device 5Y, and the cleaning device 2Y.

The photoconductor drum 1Y serving as an image bearer is a negatively-charged organic photoconductor, and is rotationally driven in the clockwise direction in FIG. 2 by a drive motor installed in the apparatus body 100. The drive motor is a motor different from the motor 122 that drives a apparatus-body drive gear 123 described later with reference to FIGS. 3A to 3C.

The photoconductor drum 1Y serving as an image bearer is a negatively-charged organic photoconductor, and is rotationally driven in the clockwise direction in FIG. 2 by a drive motor installed in the apparatus body 100. The drive motor is a motor different from the motor 122 that drives an apparatus-body drive gear 123 described later with reference to FIGS. 3A to 3C.

The cleaning device 2Y includes the cleaning blade 2*a* that slidingly contacts the photoconductor drum 1Y and mechanically removes and collects untransferred toner from the photoconductor drum 1Y. The cleaning blade 2*a* is made of an elastic material such as urethane rubber and shaped like a plate. The cleaning blade 2*a* is pressed against the photoconductor drum 1Y with a predetermined pressure, at a predetermined angle.

The developing device 5Y includes a developing roller 51 serving as a developer bearer facing the photoconductor drum 1Y with a minute gap between the developing roller 51 and the photoconductor drum 1Y. Thus, a developing region is formed (at a facing position) between the developing roller 51 and the photoconductor drum 1Y. In the developing device 5Y, toner as a developer (nonmagnetic or magnetic one-component developer) is stored. The developing device 5Y develops the electrostatic latent image on the photoconductor drum 1Y to form a toner image.

Hereinafter, the developing device 5Y is described in detail with reference to FIG. 2.

Referring to FIG. 2, the developing device 5Y according to the present embodiment is a developing device of a non-contact one-component developing system and develops an electrostatic latent image formed on the photoconductor drum 1Y. A toner container 60 as a detachable unit that contains toner (one-component developer) to be supplied to the developing device 5Y is detachably coupled to an upper portion of the developing device 5Y.

The developing device 5Y is detachably (replaceably) installed with respect to the apparatus body 100 together with other image forming members (e.g., the photoconductor drum 1Y, the cleaning device 2Y, and the charging device 4Y) as the process cartridge 6Y, and is configured such that the toner container 60 can be separately replaced with respect to the developing device 5Y (process cartridge 6Y). That is, the toner container 60 (detachable unit) is detachably (replaceably) installed at a position above the developing device 5Y (process cartridge 6Y) attached to the apparatus body 100. When the openable cover 110 (see FIG. 1) is opened about a hinge as indicated by a broken line, the toner container 60 is separated from the developing device 5Y and only the toner container 60 is replaced, or the developing device 5Y (process cartridge 6Y) to which the toner container 60 is attached is replaced.

The replacement of the toner container 60 is performed at a timing when the toner stored in the toner container 60 runs out, and the replacement of the developing device 5Y (process cartridge 6Y) is performed at a timing when components (for example, the developing roller 5 and the photoconductor drum 1Y) reach the end of their lives and the toner in the developing device 5Y runs out. Accordingly, the replacement of the toner container 60 may be performed independently. However, the replacement of the developing device 5Y (process cartridge 6Y) is performed together with the toner container 60 (in a state in which the toner container 60 is mounted).

In the present embodiment, the toner container 60 as the detachable unit is installed so as to be held by an installation portion 111 (see FIG. 1) of the apparatus body 100 of the image forming apparatus 1000.

As illustrated in FIG. 1, in the present embodiment, the exposure device 7 is securely installed inside the openable cover 110 and moves together with the openable cover 110 in conjunction with the opening or closing operation of the openable cover 110.

Referring to FIG. 2, the developing device 5Y includes a developing roller 51 serving as a developer bearer, a supply roller 53 serving as a developer supply member, a doctor blade 52 serving as a developer regulating member, a first conveying screw 54 and a second conveying screw 55 serving as a plurality of conveying members, a partition 56 that separates a first conveying path B1 including the first conveying screw 54 from a second conveying path B2 including the second conveying screw 55, and a supply port 57 through Which toner is supplied from the toner container 60.

The developing roller 51 (developer bearer) faces the photoconductor drum 1Y and supplies toner (developer) to the electrostatic latent image formed on the photoconductor drum 1Y. As the developing roller 51, a roller including a roller portion made of an iron-based material or an aluminum-based material on a rotating shaft portion (cure metal) made of a conductive metal material such as stainless steel can be used.

The supply roller 53 (developer supply member) is disposed below the two conveying screws 54 and 55 and supplies toner to the developing roller 51 while being in sliding contact with the developing roller 51. In the supply roller 53, a foamed polyurethane layer having conductivity (e.g., having an electric resistance value of about $10^3\Omega$ to about $10^{14}\Omega$ is laminated on a core metal. The supply roller 53 also has a function of removing, from the developing roller 51, the toner on the developing roller 51 that has not been subjected to the developing step in the developing region between the supply roller 53 and the photoconductor drum 1Y.

The doctor blade 52 (developer regulating member) is disposed in a manner such that a distal end thereof contacts the outer peripheral surface of the developing roller 51 at a predetermined angle of about 10 N/m to about 100 N/m and regulates the amount of the developer borne on the developing roller 51. As the doctor blade 52, a thin plate-shaped member made of a metal material such as stainless steel can be used.

Here, a predetermined voltage is applied to the developing roller 51, the supply roller 53, and the doctor blade 52 from a power supply unit, and the movement of toner on the developing roller 51 is promoted.

The two conveying screws 54 and 55 (conveying members) convey the toner accommodated in the developing device 5Y in an axial direction (a direction perpendicular to the surface of a sheet on which FIG. 2 is drawn) in a state of being mounted on the apparatus body 100 to form a circulating path.

The first conveying screw 54 serving as a first conveying member is disposed at a position facing the supply roller 53 (above the supply roller 53) and supplies toner onto the supply roller 53 while conveying the toner horizontally in the axial direction (longitudinal direction), in other words, conveying the toner from the front side to the back side in the direction perpendicular to the surface of the sheet on which FIG. 2 is drawn.

The second conveying screw 55 as a second conveying member is disposed at a position facing the first conveying screw 54 (above the first conveying screw 54 via the partition 56 and horizontally conveys toner in the axial direction (longitudinal direction), in other words, conveying the toner from the back side to the front side in the direction perpendicular to the surface of a sheet on which FIG. 2 is drawn. The second conveying screw 55 conveys the toner, which is circulated from the downstream side of the first conveying path B1 including the first conveying screw 54 via a second relay portion, to the upstream side of the first conveying path B1 via a first relay portion.

Similarly to the developing roller 51 and the photoconductor drum 1Y, the two conveying screws 54 and 55 are disposed in a manner such that the rotation axes of the two conveying screws 54 and 55 are substantially horizontal. Each of the two conveying screws 54 and 55 has a screw portion spirally wound around a shaft portion thereof.

The conveying path (first conveying path B1) formed by the first conveying screw 54 and the conveying path (second conveying path B2) formed by the second conveying screw 55 are separated from each other by the partition 56 (wall).

The downstream side of the second conveying path B2 including the second conveying screw 55 and the upstream side of the first conveying path B1 including the first conveying screw 54 communicate with each other via the first relay portion. The toner that has reached the downstream side of the second conveying path B2 including the second conveying screw 55 falls by its own weight at the first relay portion and reaches the upstream side of the first conveying path B1.

The downstream side of the first conveying path B1 including the first conveying screw 54 and the upstream side of the second conveying path B2 including the second conveying screw 55 communicate with each other via the second relay portion. The toner that has not been supplied onto the supply roller 53 in the first conveying path B1 remains and rises in the vicinity of the second relay portion, and is conveyed (supplied) to the upstream side of the second transport path B2 via the second relay portion.

In order to enhance the toner conveying performance in the second relay portion (transfer of toner from the first conveying path B1 to the second conveying path B2 against the direction of gravity), a paddle-shaped portion or a screw portion in which the winding direction of the screw is reversed may be provided at a position downstream of the first conveying screw 54 (corresponding to the second relay portion).

Referring to FIG. 2, the developing device 5Y includes a container supply port 63 of the toner container 60 at an upper position of the developing device 5Y. The supply port 57 is for supplying toner (developer) from the tuner container 60 to the developing device 5Y.

Gears are provided on shaft portions of the developing roller 51, the supply roller 53, the first conveying screw 54, and the second conveying screw 55 and constitute a gear train including idler gears. A driving three is input to the gear train from a driving motor (driving device), and the developing roller 51, the supply roller 53, the first conveying screw 54, and the second conveying screw 55 are driven to rotate in directions indicated by arrows in FIG. 2.

The toner container 60 as a detachable unit includes, for example, an agitator 61 and a toner conveying screw 62 as a rotary body.

The agitator 61 includes a thin plate-shaped flexible member attached to a rotation shaft portion thereof and rotates counterclockwise in FIG. 2 to convey the toner stored in a storage portion C of the toner container 60 toward a conveying path formed by the toner conveying screw 62.

Figure 3A:
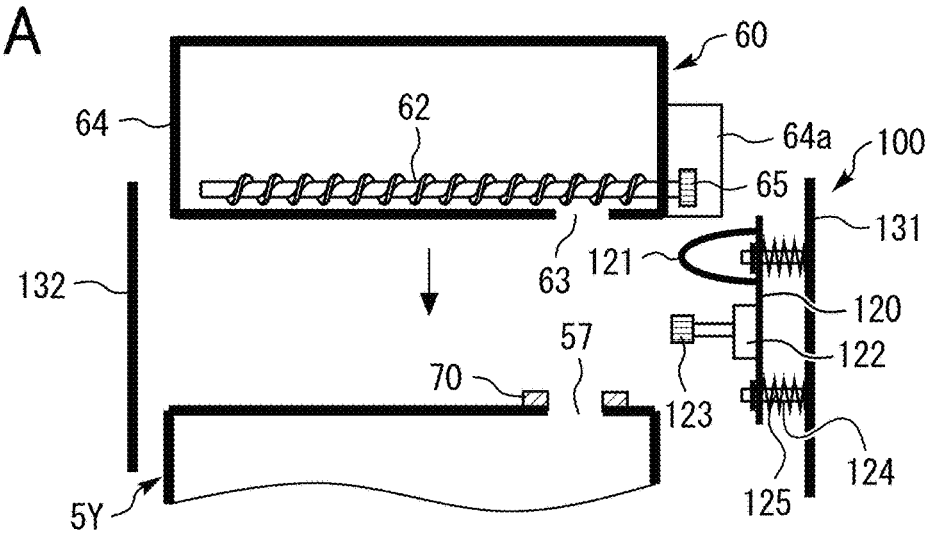
FIGS. 3A, 3B, and 3C are schematic diagrams illustrating an operation of attaching a toner container to an apparatus body of the image forming apparatus of FIG. 1.
Figure 3B:
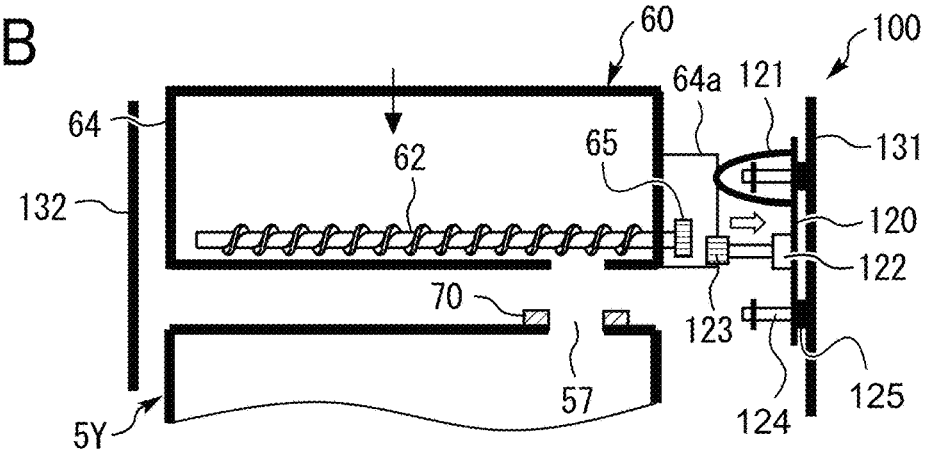
Figure 3C:
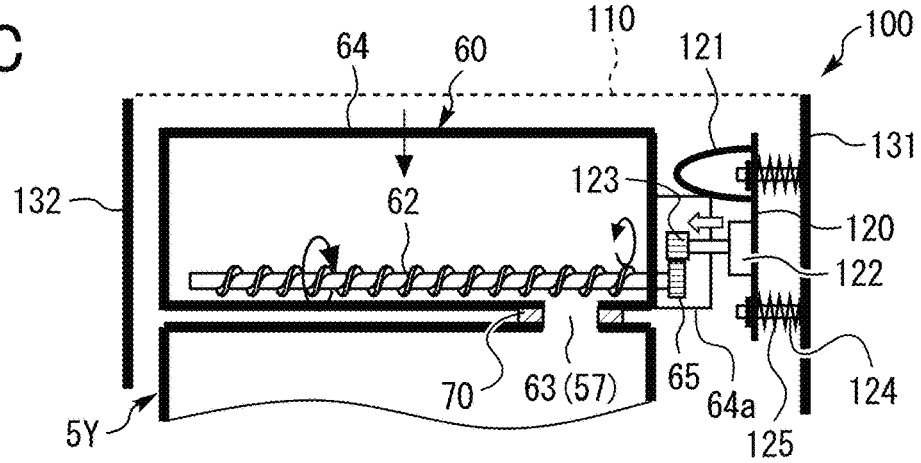

The toner conveying screw 62 as a rotary body conveys the toner stored in the container toward the container supply port 63 (disposed on one end portion in the longitudinal direction as illustrated in FIG. 3C) in a state in which the toner conveying screw 62 is attached to the apparatus body 100 of the image forming apparatus 1000. The toner conveying screw 62 has a screw portion spirally wound around a shaft portion.

The container supply port 63 is formed on one end portion (driving side) in the longitudinal direction in the conveying path formed by the toner conveying screw 62. The toner discharged from the container supply port 63 is supplied to the upstream side of the developing device 5Y in the second transport path B2 through the supply port 57 by its own weight drop.

The container supply port 63 of the toner container 60 and the supply port 57 on the developing device 5Y are connected to each other via a seal member 70 (see FIG. 3C) serving as an elastic member.

The developing device 5Y thus configured operates as follows.

First, the toner supplied from the toner container 60 into the second conveying path B2 via the supply ports 57 and 63 is supplied to the first conveying path B1 while being stirred and mixed by the second conveying screw 55 together with the toner circulated in the developing device 5Y. The toner conveyed to the first conveying path B1 is conveyed by the first conveying screw 54, and a part of the toner is supplied to and borne by the supply roller 53. The toner borne on the supply roller 53 is frictionally charged at a pressure contact portion (contact position) with the developing roller 51, and moves to and is borne on the developing roller 51. The toner borne on the developing roller 51 is made thin and uniform at a contact position with the doctor blade 52, and then reaches a position (developing region) facing the photoconductor drum 1Y. At this position, the toner is attracted to a latent image formed on the photoconductor drum 1Y by the electric field (developing electric field) formed in the developing region.

The configuration and operation of the image forming apparatus 1000 according to the present embodiment are described in further detail below.

As described above with reference to FIGS. 1 and 2, the image forming apparatus 1000 according to the present embodiment includes the toner container 60 serving as a detachable unit that is attachable to and detachable from the apparatus body 100 of the image forming apparatus 1000 in predetermined attachment and detachment directions (along a vertical direction). The toner container 60 is connected to the developing device 5Y installed in the apparatus body 100 of the image forming apparatus 1000.

Here, as illustrated in FIGS. 3A to 3C, the toner container 60 as the detachable unit is provided with the toner conveying screw 62 as a rotary body rotatable in a direction indicated by an arrow of FIG. 3C and a unit drive gear 65 that transmits drive to the toner conveying screw 62 (serving as a rotary body).

Specifically, a shaft portion of the toner conveying screw 62 (rotary body) on one end portion (right side in FIGS. 3A to 3C, in the rotation axis direction is rotatably held by a case 64 (housing) of the toner container 60 via a bearing. The unit drive gear 65 is disposed on a shaft portion on one end portion, which is a portion protruding to the outside of the case 64, in a manner such that the unit drive gear 65 is rotatable together with the toner conveying screw 62. In the present embodiment, the other end portion (left side in FIG. 3) of the toner conveying screw 62 in the rotation axis direction is not held by any member and is in a free state.

On the other hand, the apparatus body 100 of the image forming, apparatus 1000 is provided with a apparatus-body drive gear 123 that engages with the unit drive gear 65 of the toner container 60 (detachable unit) attached to the apparatus body 100 of the image forming apparatus 1000 at an engageable position on the upstream side (upper side in FIG. 3C) in the attachment direction.

Specifically, in the present embodiment, the apparatus-body drive gear 123 is installed on the motor shaft of the motor 122. When the motor 122 is driven, the driving force is transmitted from the apparatus-body drive gear 123 (driving gear) to the unit drive gear 65 (driven gear), so that the toner conveying screw 62 is driven to rotate. The agitator 61 (see FIG. 2) is rotated in a predetermined direction by the drive transmitted from the unit drive gear 65 via the gear train.

Here, in the present embodiment, at least one of the unit drive gear 65 and the apparatus-body drive gear 123 moves to a retracted position (the position illustrated in FIG. 3B) at which the gear does not engage with the other gear and does not interfere with the attachment and, detachment of the toner container 60 to and from the apparatus body 100 of the image forming apparatus 1000 when the toner container 60 (detachable unit) is attached to or detached from the apparatus body 100 of the image forming apparatus 1000.

In the present specification, "when the toner container 60 (detachable unit) is attached to or detached from the apparatus body 100 of the image forming apparatus 1000" includes not only an operation of moving the toner container 60 in the attachment and detachment directions but also all operations performed to attach or detach the toner container 60 such as opening and closing operations of the openable cover 110 described later.

Specifically, as illustrated in FIGS. 3A a to 3C, at least one of the unit drive gear 65 and the apparatus-body drive gear 123 (the apparatus-body drive gear 123 in the present embodiment) moves from the engageable position illustrated in FIGS. 3A and 3C to the retracted position illustrated in FIG. 3B and moves to the engageable position again in conjunction with the operation of attaching or detaching the toner container 60 to or from the apparatus body 100 of the image forming apparatus 1000.

Note that the apparatus-body drive gear 123 (one gear) that moves in this manner moves between the engageable position and the retracted position along the axial direction thereof (the horizontal direction in FIGS. 3A to 3C).

More specifically, the apparatus body 100 of the image forming apparatus 1000 is provided with, for example, a movable portion 120 and a compression spring 125 as a biasing member.

The movable portion 120 is a plate-shaped member that holds the apparatus-body drive gear 123 to be movable together with the apparatus-body drive gear 123. The movable portion 120 is held to be movable in the horizontal direction in FIGS. 3A to 3C by a plurality of studs 124. A motor 122 is fixed on the movable portion 120. The apparatus-body drive gear 123 is disposed on a motor shaft of the motor 122. A protruding portion 121 protruding leftward in FIG. 3 is disposed on the movable portion 120. The protruding portion 121 has a shape such that the width in the attachment direction (vertical direction in FIGS. 3A to 3C) gradually decreases from a root portion toward a tip portion of the protruding portion 121.

The compression spring 125 serves as a biasing member that biases the movable portion 120 in a manner such that the apparatus-body drive gear 123 is biased from the retracted position illustrated in FIG. 3B toward the engageable position illustrated in FIGS. 3A and 3C. Specifically, the compression spring 125 is wound around the stud 124 between an apparatus-body side plate 131 (one apparatus-body side plate of two apparatus-body side plates 131 and 132 installed at the front and rear as parts of the housing of the image forming apparatus 1000) and the movable portion 120.

A retaining ring is disposed on the stud 124 to prevent the biasing force of the compression spring 125 from moving the movable portion 120 to the left in FIG. 3A without limit.

A harness for supplying electric power to the motor 122 has a sufficient length and is optimally arranged so as not to be entangled with or broken by other members even when the motor 122 moves in the horizontal direction in FIGS. 3A-3C together with the movable portion 120.

On the other hand, in the toner container 60, a pushing portion 64*a* is disposed on the case 64 as a housing so as to protrude to the right in FIG. 3A.

The pushing portion 64*a* presses the movable portion 120 in a manner such that the apparatus-body drive gear 123 moves from the engageable position to the retracted position against the biasing, force of the compression spring 125 (biasing member) in conjunction with the operation of attaching and detaching the toner container 60 (detachable unit) to and from the apparatus body 100 of the image forming apparatus 1000.

Hereinafter, an operation in attachment of the toner container 60 to the apparatus body 100 of the image forming apparatus 1000 is described with reference to FIGS. 3A to 3C.

First, the openable cover 110 (see FIG. 1) is rotated to an open position to expose the installation portion 111 (a portion where the toner container 60 is installed, see FIG. 1)

of the apparatus body 100 of the image forming apparatus 1000 upward. As illustrated in FIG. 3A, the toner container 60 is moved in a direction indicated by an arrow from above to below, which is, for example, movement by manual operation of the operator. At this time, as illustrated in FIG. 3A, the movable portion 120 of the apparatus body 100 of the image forming apparatus 1000 is positioned on the left side by the compression spring 125, and the apparatus-body drive gear 123 is positioned at the engageable position. The apparatus body 100 of the image forming apparatus 1000 is provided with a guide portion that guides the movement of the toner container 60 in the attachment and detachment directions so that the toner container 60 can be smoothly attached and detached in a proper posture.

As illustrated in FIG. 3B, when the toner container 60 is moved downward, the pushing portion 64*a* of the toner container 60 comes into contact with the protruding portion 121 of the movable portion 120. As the pushing portion 64*a* moves downward, the protruding portion 121 (movable portion 120) is pushed to the right (in the direction indicated by the white arrow in FIG. 3B) against the biasing force of the compression spring 125. Thus, the apparatus-body drive gear 123 moves to the retracted position without interfering with the toner container 60.

As illustrated in FIG. 3C, when the toner container 60 is further moved downward, the attachment of the toner container 60 to the installation portion 111 (which is a position at which the toner container 60 is connected to the developing device 5Y) is completed. At this time, the pushing of the protruding portion 121 (movable portion 120) by the pushing portion 64*a* is released, and the movable portion 120 moves to the left (in the direction indicated by the white arrow in FIG. 3C) by the biasing of the compression spring 125. Accordingly, the apparatus-body drive gear 123 moves to the engageable position and engages with the unit drive gear 65. The container supply port 63 of the toner container 60 and the supply port 57 of the developing device 5Y communicate with each other via the seal member 70 (in an elastically deformed state) made of, for example, foamed polyurethane. After the attachment of the toner container 60 is completed, the openable cover 110 is closed.

On the other hand, when the toner container 60 is taken out from the apparatus body 100 of the image forming apparatus 1000, an operation reverse to the above-described attachment operation is performed.

A shutter member that opens and closes the supply port in conjunction with attachment and detachment of the toner container 60 may be provided in the container supply port 63 or the supply port 57.

As described above, the image forming apparatus 1000 according to the present embodiment is configured such that the apparatus-body drive gear 123 of the apparatus body 100 of the image forming apparatus 1000 engages with the unit drive gear 65 of the toner container 60 not on the upstream side in the attachment direction but on the downstream side in the attachment direction. Accordingly, a failure in which the engagement between the apparatus-body drive gear 123 and the unit drive gear 65 is shallow is less likely to occur than a case where the apparatus-body drive gear 123 engages with the unit drive gear 65 on the upstream side in the attachment direction.

In other words, in a case where the apparatus-body drive gear 123 engages with the unit drive gear 65 on the upstream side in the attachment direction, the unit drive gear 65 receives a force from the apparatus-body drive gear 123 during operation and separates (floats) to the downstream side in the attachment direction, and a failure in which the engagement of the unit drive gear 65 and the apparatus-body drive gear 123 is shallow is likely to occur. If such a failure occurs, for example, a driving failure of the toner container 60 or abnormal noise due to tooth skipping of the unit drive gear 65 and the apparatus-body drive gear 123 may occur.

On the other hand, in the present embodiment, the apparatus-body drive gear 123 engages with the unit drive gear 65 on the downstream side in the attachment direction to regulate the movement of the unit drive gear 65 on the downstream side in the attachment direction, even if the unit drive gear 65 receives a force from the apparatus-body drive gear 123 during operation. Accordingly, the unit drive gear 65 is not likely to separate (not likely to float), and the failure of the shallow engagement of the unit drive gear 65 and the apparatus-body drive gear 123 is not likely to occur. In particular, in the present embodiment, the toner container 60 is set in the direction of gravity, and the weight of the toner container 60 efficiently acts as a member regulating the movement of the toner container 60 toward the downstream side in the attachment direction. Accordingly, the above-described failure is further unlikely to occur.

In the present embodiment, in order to engage the apparatus-body drive gear 123 with the unit drive gear 65 on the downstream side in the attachment direction, the apparatus-body drive gear 123 is temporarily moved to the retracted position in conjunction with the attachment and detachment operations of the toner container 60. Such a configuration can reduce the failure that the engagement of the unit drive gear 65 and the apparatus-body drive gear 123 is shallow as described above, without deteriorating the attachment and detachment operability of the toner container 60.

The effects of embodiments of the present disclosure are further described below.

When the toner container 60 is attached to the apparatus body 100 of the image forming apparatus 1000, the toner container 60 receives an upward force due to a reaction force (elastic force) of the seal member 70 provided in the supply port 57 of the developing device. However, in the present embodiment, the apparatus-body drive gear 123 is disposed at a position where the upward floating of the toner container 60 is restrained. Such a configuration can prevent the occurrence of abnormal noise caused by the shallow engagement between the apparatus-body drive gear 123 and the unit drive gear 65. Such a configuration obviates the necessity to provide a dedicated member for restraining the upward floating of the toner container 60, thus allowing reduction in the cost and site of the apparatus.

In the present embodiment, the inter-axis distance between the unit drive gear 65 and the apparatus-body drive gear 123 is restricted in directions away from each other, but is not restricted in directions toward each other. For this reason, as it is, vibration generated by contact between the tooth bottoms of the unit drive gear 65 and the apparatus-body drive gear 123 or strong contact between the tooth surfaces of the unit drive gear 65 and the apparatus-body drive gear 123 might be transmitted to the developing device 5Y, and there is a possibility that an image defect due to banding occurs in the developing process. On the other hand, in the present embodiment, since the toner container 60 and the developing device 5Y are connected to each other via 70 the seal member (elastic member), vibration caused by the contact of the tooth bottoms of the unit drive gear 65 and the apparatus-body drive gear 123 or strong, contact between the tooth surfaces of the unit drive gear 65 and the apparatus-body drive gear 123 is less likely to be transmitted to the developing device 5Y, and such an image defect is less likely to occur.

In addition, for the same reason, vibration generated due to contact between tooth bottoms of the unit drive gear 65 and the apparatus-body drive gear 123 or strong contact between tooth surfaces of the unit drive gear 65 and the apparatus-body drive gear 123 may be transmitted to the exposure device 7 through the installation portion 111 or the like, and there is a possibility that an image defect due to banding occurs in the exposure process. For this reason, preferably, a contact member, such as the installation portion 111, which comes into contact with the toner container 60 has a configuration to contact the toner container 60 via a member having vibration damping properties or vibration damping properties, such as an elastic member.

When such an elastic member or the like is provided, it is preferable that the contact member and the toner container 60 are laid out so as not to be in contact with each other on the assumption that no elastic member is provided.

Figure 4:
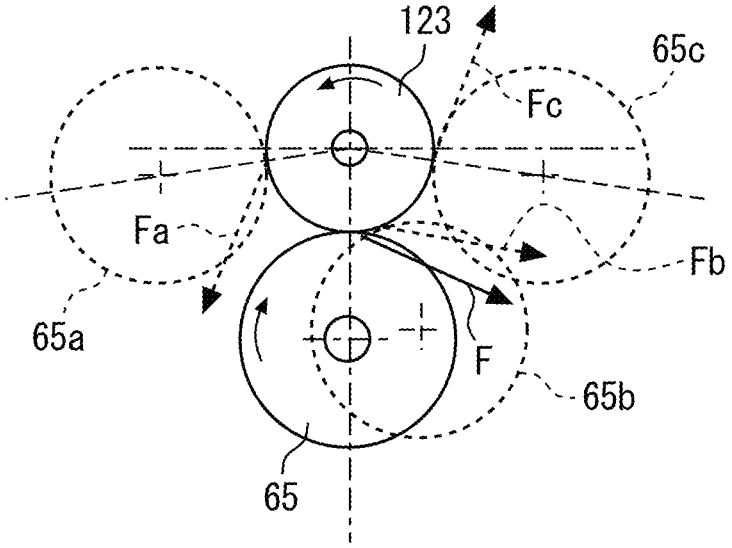
FIG. 4 is a diagram illustrating relative positions of an apparatus-body drive gear and a unit drive gear.

Referring to FIG. 4, in the present embodiment, when the drive is transmitted from the apparatus-body drive gear 123 to the unit drive gear 65, a force F (in the direction of the pressure angle of the gear) received by the unit drive gear 65 from the apparatus-body drive gear 1 is set to act in the direction in which the toner container 60 (detachable unit) is biased to the upstream side in the attachment direction.

In the toner container 60 to be attached in the gravity direction, the unit drive gear 65 is positioned below the apparatus-body drive gear 123. In other words, since the rotation center of the unit drive gear 65 is disposed below the rotation center of the apparatus-body drive gear 123, the unit drive gear 65 can be installed within a range in the counterclockwise direction from a first position of a unit drive gear 65*a* to a third position of a unit drive gear 65*c* indicated by broken lines in FIG. 4 around the rotation center of the apparatus-body drive gear 123. However, if a force Fc received from the apparatus-body drive gear 123 acts upward as in the case of the unit drive gear 65*c* at the third position during operation, the toner container 60 is likely to move upward. Accordingly, undesirably, the tooth bottoms of the unit drive gear 65 and the apparatus-body drive gear 123 are likely to come into contact with each other, or the toner container 60 is likely to separate from the developing device 5Y, thus causing toner to leak from the supply port.

In order to reduce such failures, the force F (Fa or Fb) received by the unit drive gear 65 from the apparatus-body drive gear 123 is set to act downward during operation. To be more specific, around the rotation center of the apparatus-body drive gear 123, the force F (Fa or Fb) is set to act downward within a range in the counterclockwise direction from the first position of the unit drive gear 65*a* illustrated by a broken line in FIG. 4 to the second position of the unit drive gear 65*b* around the rotation center of the apparatus-body drive gear 123.

In the present embodiment, the reaction force (excluding the rotational component due to gear transmission) applied to the unit drive gear 65 by the apparatus-body drive gear 123 includes a reaction force including a component in the attachment direction.

In particular, in the toner container 60 according to the present embodiment, the case 64 (housing) is installed in the apparatus body 100 of the image forming apparatus 1000 by its own weight without being, biased downward by a biasing unit (for example, a spring installed in the openable cover 110), in other words, without installing the biasing unit. That is, there is no means for forcibly limiting the upward floating of the toner container 60. Therefore, as described above, it is useful to set the force F received by the unit drive gear 65 from the apparatus-body drive gear 123 to act downward.

In the present embodiment, the sealing member 70 (elastic member) provided in the supply ports 57 and 63 apply force to the toner container 60 in a direction away from the developing device 5Y (or upward). Accordingly, the unit drive gear 65 receives a reaction force including a component in a direction against the force from the apparatus-body drive gear 123.

First Variation

Figure 5A:
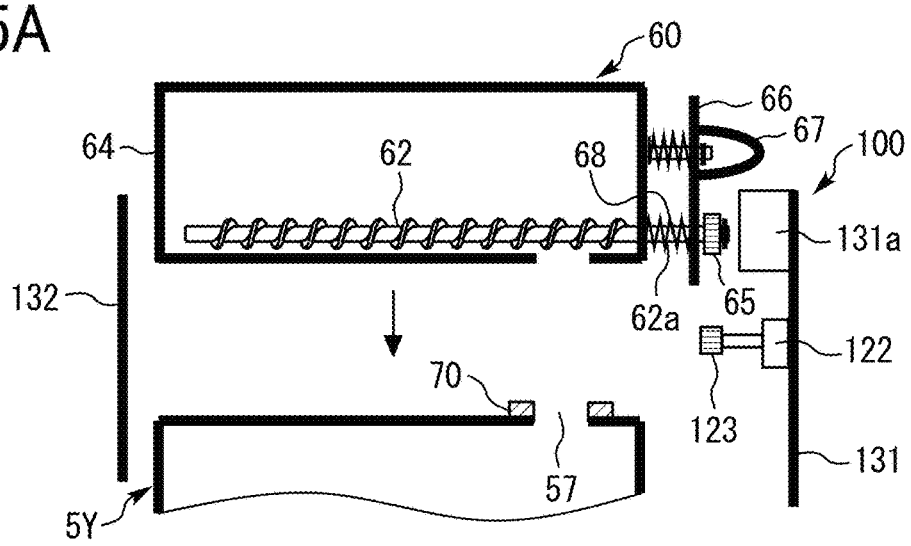
FIGS. 5A, 5B, and 5C are diagrams illustrating an operation of attaching a toner container in an image forming apparatus according to a first variation.
Figure 5B:
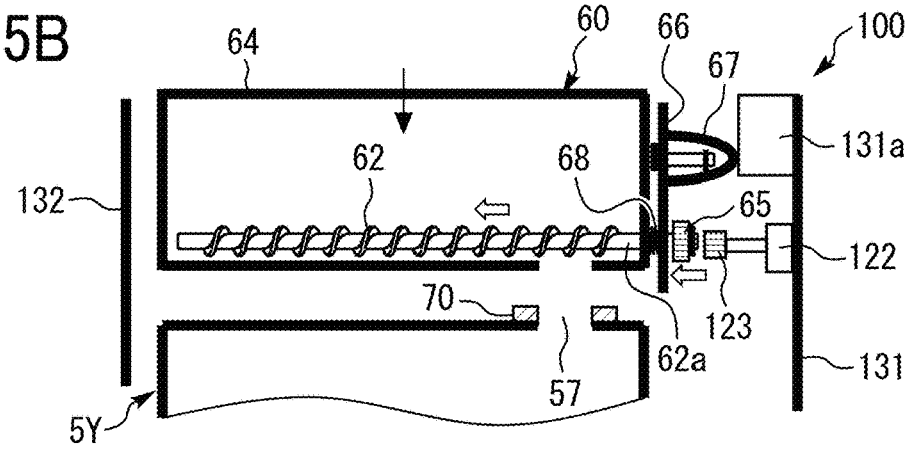
Figure 5C:
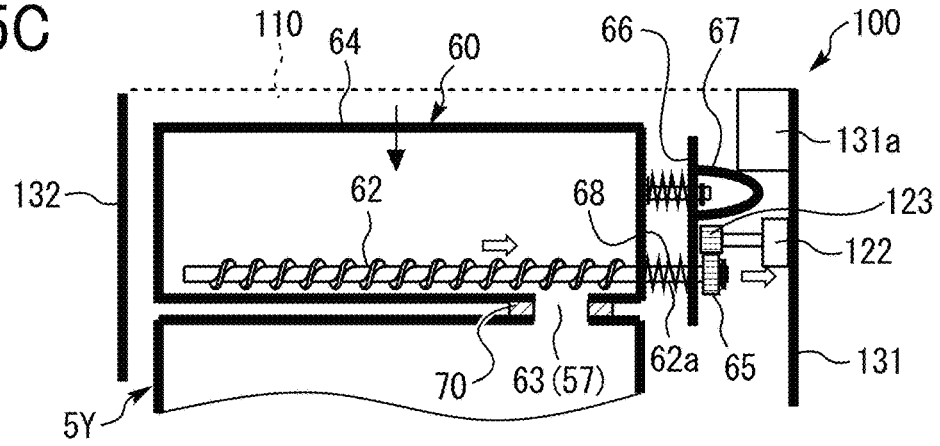

As illustrated in FIGS. 5A to 5C, in an image forming apparatus 1000 according to a first variation, not the apparatus-body drive gear 123 but the unit drive gear 65 moves from the engageable position illustrated in FIGS. 5A and 5C to the retracted position illustrated in FIG. 5B and then moves to the engageable position again, in conjunction with the operation of attaching and detaching the toner container 60 to and from the apparatus body 100 of the image forming apparatus 1000. The unit drive gear 65 (one gear) moves between the engageable position and the retracted position along the axial direction (the horizontal direction in FIGS. 5A to 5C).

More specifically, the toner container 60 (detachable unit) is provided with, for example, a movable portion 66 and a compression spring 68 as a biasing member.

The movable portion 66 is a plate-shaped member that rotatably holds the unit drive gear 65 to be movable together with the unit drive gear 65. The movable portion 66 is held by the shaft portion 62*a* of the toner conveying screw 62 and a stud so as to be movable in the horizontal direction in FIG. 5A. The movable portion 66 has a protruding portion 67 protruding rightward in FIG. 5A. The protruding portion 67 has a shape such that the width in the attachment direction (vertical direction in FIG. 5A) gradually decreases from a root portion toward a tip portion of the protruding portion 67.

The compression spring 68 functions as a biasing member that biases the movable portion 66 in a manner such that the unit drive gear 65 is biased from the retracted position illustrated in FIG. 5B toward the engageable position illustrated in FIGS. 5A and 5C. Specifically, the compression spring 68 is wound around the shaft portion 62*a* or the stud between the case 64 and the movable portion 66.

A retaining ring is provided on the shaft portion 62*a* and the stud, thus preventing the biasing force of the compression spring 68 from moving the movable portion 66 to the right in FIG. 3 without limit.

On the other hand, in the apparatus body 100 of the image forming apparatus 1000 according to the first variation, a pushing portion 131*a* protruding leftward in FIG. 5A is disposed on an apparatus-body side plate 131.

The pushing portion 131*a* presses the movable portion 66 in a manner such that the unit drive gear 65 moves from the engageable position to the retracted position against the biasing force of the compression spring 68 (biasing member) in conjunction with the operation of attaching and detaching the toner container 60 (detachable unit) to and from the apparatus body 100 of the image forming apparatus 1000.

The apparatus-body side plate 131 is provided with a motor 122 that drives the apparatus-body drive gear 123.

Hereinafter, an operation in attachment of the toner container 60 to the apparatus body 100 of the image forming apparatus 1000 in the first variation is described with reference to FIGS. 5A to 5C.

First, the openable cover 110 (see FIG. 1) is rotated to an open position to expose the installation portion 111 (a portion where the toner container 60 is installed, see FIG. 1)

of the apparatus body 100 of the image forming apparatus 1000 upward. As illustrated in FIG. 5A, the toner container 60 is moved in a direction indicated by an arrow from above to below. At this time, as illustrated in FIG. 5A, the movable portion 66 of the toner container 60 is positioned on the right side by the compression spring 68, and the unit drive gear 65 is positioned at the engageable position.

Figure 6A:
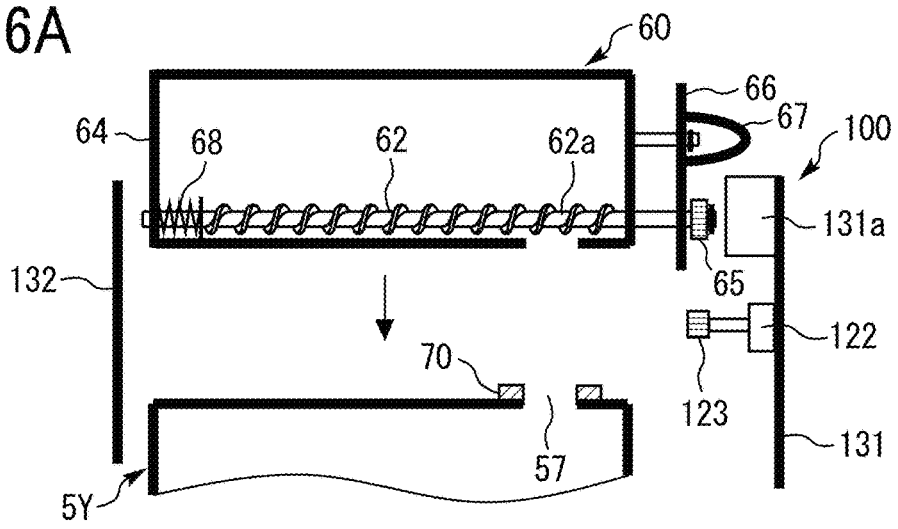
FIGS. 6A, 6B, and 6C are diagrams illustrating an operation of attaching a toner container in an image forming apparatus according to a second variation.
Figure 6B:
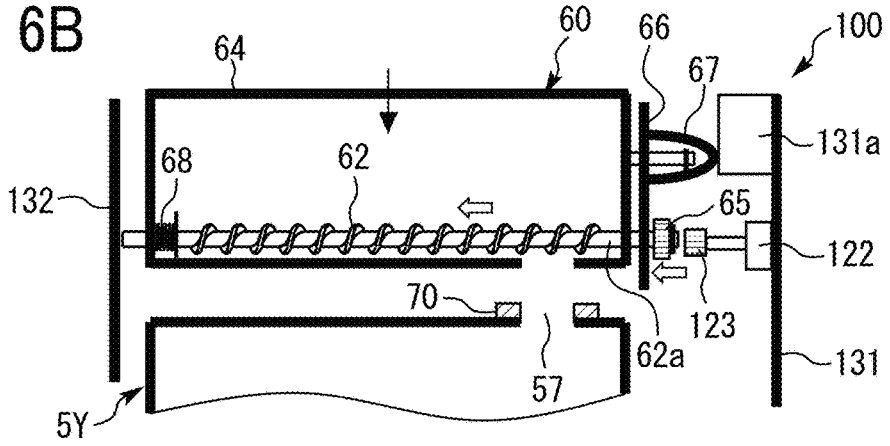

As illustrated in FIG. 6B, when the toner container 60 is moved downward, the pushing portion 131*a* of the apparatus body 100 of the image forming apparatus 1000 comes into contact with the protruding portion 67 of the movable portion 66. The protruding portion 67 (movable portion 66) is pushed to the left (in a direction indicated by a white arrow in FIG. 5B) against the biasing force of the compression spring 68 as the pushing portion 131*a* relatively moves upward. Thus, the unit drive gear 65 moves to the retracted position without interfering with the apparatus body 100 of the image forming apparatus 1000.

As illustrated in FIG. 5C, the toner container 60 is further moved downward, and the attachment of the toner container 60 to the installation portion 111 (which is a position at which the toner container 60 is connected to the developing device 5Y) is completed. At this time, the pushing of the protruding portion 67 (movable portion 66) by the pushing portion 131*a* is released, and the movable portion 66 moves to the right (in a direction indicated by a white arrow in FIG. 5C) by the biasing of the compression spring 68. Accordingly, the unit drive gear 65 moves to the engageable position and engages with the apparatus-body drive gear 123. The container supply port 63 of the toner container 60 and the supply port 57 of the developing device 5Y communicate with each other via the seal member 70 (in an elastically deformed state) made of, for example, foamed polyurethane. After the attachment of the toner container 60 is completed, the openable cover 110 is closed.

On the other hand, when the toner container 60 is taken out from the apparatus body 100 of the image forming apparatus 1000, an operation reverse to the above-described attachment operation is performed.

In the image loaning apparatus 1000 according to the first variation having the above-described configuration, the failure of the shallow engagement between the apparatus-body drive gear 123 of the apparatus body 100 of the image forming apparatus 1000 and the unit drive gear 65 of the toner container 60 (detachable unit) is also less likely to occur.

Here, in the first variation, as illustrated in FIGS. 5A to 5C, the toner conveying screw 62 as the rotary body moves along, the rotation axis direction (the horizontal direction in FIGS. 5A to 5C) in conjunction with the movement of the unit drive gear 65 between the engageable position and the retracted position along the axial direction.

With such a configuration, even if the toner in the toner container 60 before replacement is biased to one side in the longitudinal direction due to transportation or the like, the toner conveying screw 62 moves in the longitudinal direction (rotation axis direction) in conjunction with the operation of attaching the toner container 60 to the apparatus body 100 of the image forming apparatus 1000, thus allowing the biased toner to be loosened.

Second Variation

Figure 6C:
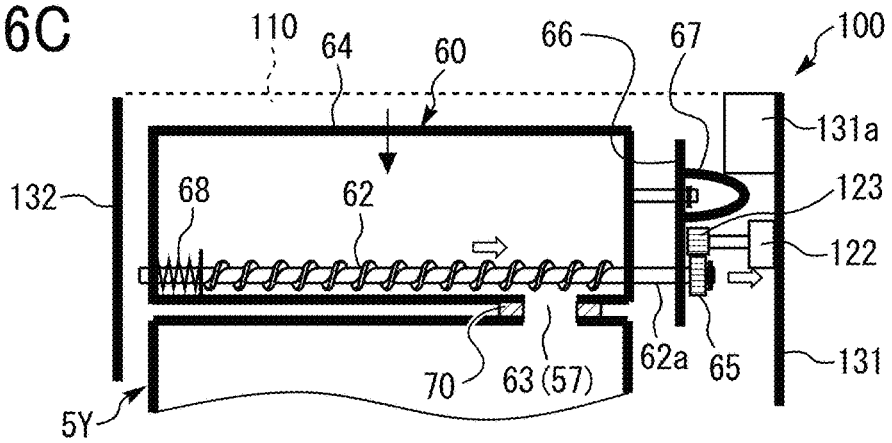

As illustrated in FIGS. 6A to 6C, in an image forming apparatus 1000 according to a second variation, similarly to the image forming apparatus 1000 according to the first variation, the unit drive gear 65 is configured to move in the axial direction in conjunction with the operation of attaching and detaching the toner container 60 to and from the apparatus body 100 of the image forming apparatus 1000.

However, in the second variation, the compression spring 68 serving as a biasing member is disposed not on a portion close to the unit drive gear 65 (one end portion in the rotation axis direction) but on the opposite side the other end portion in the rotation axis direction).

More specifically, in the second variation, the toner conveying screw 62 is rotatably held by the case 64 at both ends of a shaft portion 62*a* of the toner conveying screw 62. The compression spring 68 is wound around the shaft portion 62*a* between a retaining ring and an inner wall surface of the case 64.

In the image forming apparatus 1000 according to the second variation having the above-described configuration, the failure of the shallow engagement between the apparatus-body drive gear 123 of the apparatus body 100 of the image forming apparatus 1000 and the unit drive gear 65 of the toner container 60 (detachable unit) is also less likely to occur.

Third Variation

Figure 7A:
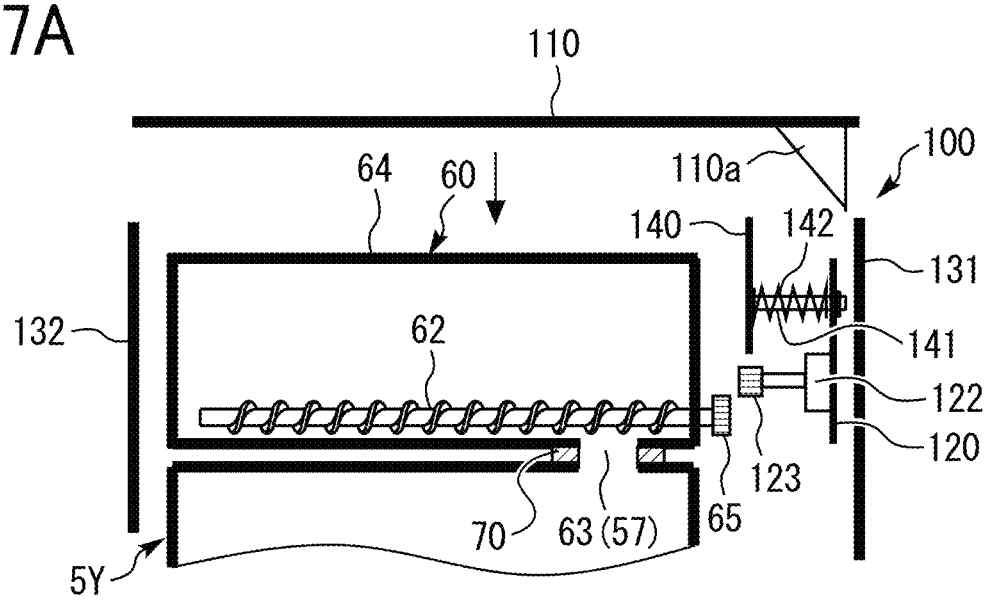
FIGS. 7A and 7B are diagrams illustrating an operation of closing an openable cover in an image forming apparatus according to a third variation.
Figure 7B:
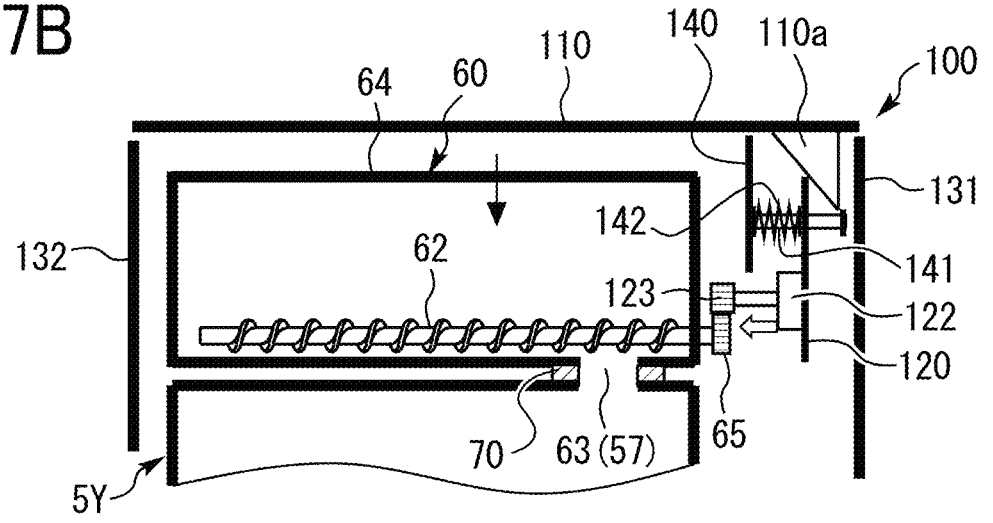

As illustrated in FIGS. 7A and 7B, in an image forming apparatus 1000 according to a third variation, at least one of the unit drive gear 65 and the apparatus-body drive gear 123 (the apparatus-body drive gear 123 in the third variation) moves from the retracted position illustrated in FIG. 7A to the engageable position illustrated in FIG. 7B in conjunction with the closing operation of the openable cover 110 and moves from the engageable position illustrated in FIG. 7B to the retracted position illustrated in FIG. 7A in conjunction with the opening operation of the openable cover 110 in a state where the toner container 60 (detachable unit) is attached in the apparatus body 100 of the image forming apparatus 1000. As described above with reference to FIG. 1, the openable cover 110 is a member that is opened and closed to attach and detach the toner container 60 (detachable unit) to and from the apparatus body 100 of the image conning apparatus 1000.

Specifically, the apparatus body 100 of the image forming apparatus 1000 is provided with, for example, a movable portion 120 and a compression spring 142 as a biasing member.

The movable portion 120 is a plate-shaped member that holds the apparatus-body drive gear 123 to be movable together with the apparatus-body drive gear 123. The movable portion 120 is held by a stud 141 so as to be movable in the horizontal direction in FIG. 7A. A motor 122 is fixedly mounted on the movable portion 120. The apparatus-body drive gear 123 is mounted on a motor shall of the motor 122.

The compression spring 142 functions as a biasing member that biases the movable portion 120 in a manner such that the apparatus-body drive gear 123 is biased from the engageable position illustrated in FIG. 7B toward the retracted position illustrated in FIG. 7A, Specifically, the compression spring 142 is wound around the stud 141 between the apparatus-body side plate 140 and the movable portion 120.

A retaining ring is provided on the stud 141 to prevent the biasing force of the compression spring 142 from moving the movable portion 120 to the right in FIG. 7A without limit.

On the other hand, in the third variation, the openable cover 110 has a pushing portion 110*a* protruding downward in FIG. 7A.

The pushing portion 110*a* pushes the movable portion 120 in a manner such that the apparatus-body drive gear 123 moves from the retracted position to the engageable position against the biasing force of the compression spring 142 (biasing member) in conjunction with the operation of closing the openable cover 110 in a state where the toner container 60 (detachable unit) is attached in the apparatus body 100 of the image forming apparatus 1000. The pushing portion 110*a* has a shape such that the width in the direction orthogonal to the opening or closing direction (the horizontal direction in FIG. 7A) gradually decreases from a root portion toward a tip portion of the pushing portion 110*a*.

Hereinafter, with reference to FIGS. 7A and 7B, an operation in attachment of the toner container 60 to the apparatus body 100 of the image forming apparatus 1000 in the third variation is described.

First, the openable cover 110 (see FIG. 1) is rotated to an open position to expose the installation portion 111 (aa portion where the toner container 60 is installed, see FIG. 1) of the apparatus body 100 of the image forming apparatus 1000 upward. As illustrated in FIG. 7A, the toner container 60 is set on the installation 111. At this time, as illustrated in FIG. 7A, the movable portion 120 of the apparatus body 100 of the image forming apparatus 1000 is positioned on the right side by the biasing three of the compression spring 142, and the apparatus-body drive gear 123 is positioned at the retracted position.

As illustrated in FIG. 7B, when the openable cover 110 is closed, the pushing portion 110*a* pushes the movable portion 120 against the biasing force of the compression spring 142. Accordingly, the apparatus-body drive gear 123 moves to the engageable position and engages with the unit drive gear 65. In this way, the openable cover 110 is closed, and a series of attachment operations of the toner container 60 is completed.

On the other hand, when the toner container 60 is taken out from the apparatus body 100 of the image forming apparatus 1000, an operation reverse to the above-described attachment operation is performed.

In the image forming apparatus 1000 according to the third variation having the above-described configuration, the failure of the shallow engagement between the apparatus-body drive gear 123 of the apparatus body 100 of the image forming apparatus 1000 and the unit drive gear 65 of the toner container 60 (detatchable unit) is also less likely to occur.

In the third variation, regardless of whether the toner container 60 is attached in the apparatus body 100 of the image forming apparatus 1000, the apparatus-body drive gear 123 moves between the retracted position and the engageable position in conjunction with the opening and closing operations of the openable cover 110.

Fourth Variation

Figure 8A:
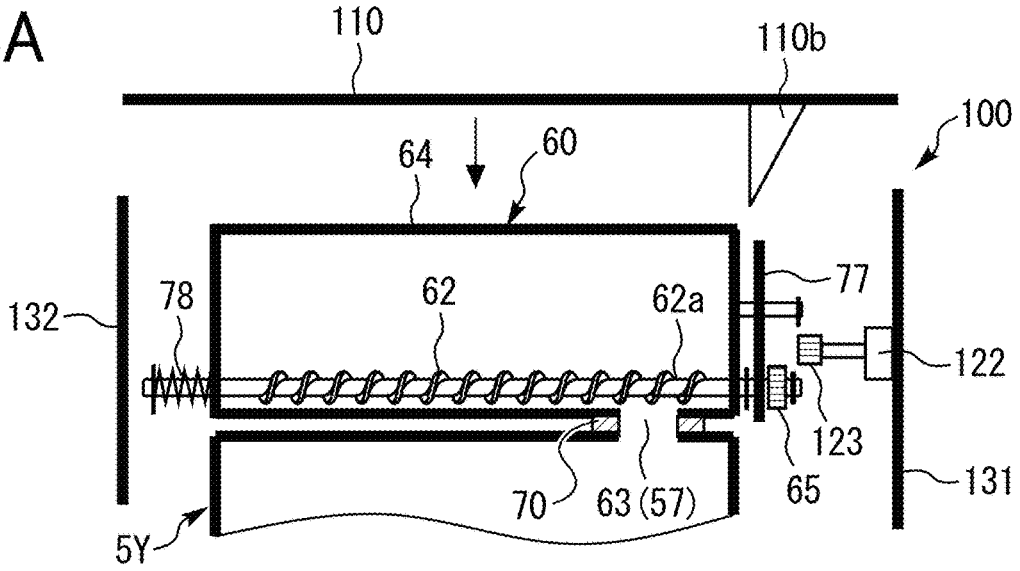
FIGS. 8A and 8B are diagrams illustrating an operation of closing an openable cover in an image forming apparatus according to a fourth variation.
Figure 8B:
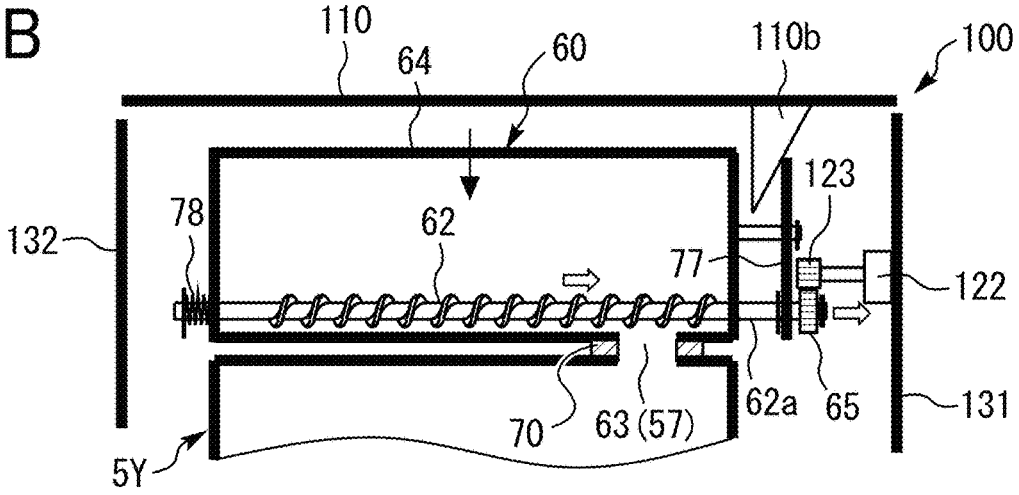

As illustrated in FIGS. 8A and 8B, in an image forming apparatus 1000 according to a fourth variation, the unit drive gear 65 instead of the apparatus-body drive gear 123 moves between the retracted position illustrated in FIG. 8A and the engageable position illustrated in FIG. 8B in conjunction with the opening and closing operations of the openable cover 110.

Specifically, the twit drive gear 65 moves from the retracted position illustrated in FIG. 8A to the engageable position illustrated in FIG. 8B in conjunction with the closing operation of the openable cover 110 in a state in which the toner container 60 is attached in the apparatus body 100 of the image forming apparatus 1000, and moves from the engageable position illustrated in FIG. 8B to the retracted position illustrated in FIG. 8A in conjunction with the opening operation of the openable cover 110.

More specifically, the toner container 60 is provided with, for example, a movable portion 77 and a compression spring 78 as a biasing member.

The movable portion 77 is a plate-shaped member that is movable together with the unit drive gear 65 and rotatably holds the unit drive gear 65. The movable portion 77 is held by a stud so as to be movable in the horizontal direction in FIG. 8A.

The compression spring 78 functions as a biasing member that biases the movable portion 77 in a manner such that the unit drive gear 65 is biased from the engageable position illustrated in FIG. 88 toward the retracted position illustrated in FIG. 8A. To be more specific, the compression spring 78 is wound around the shaft portion 62*a* of the toner conveying screw 62 between an outer wall surface of the case 64 and a retaining ring. The retaining ring is provided on the shaft portion 62*a* on the other end of the toner conveying screw 62 opposite the one end on which the unit drive gear 65 is provided.

The motor 122 is fixedly mounted on the apparatus-body side plate 131. The apparatus-body drive gear 123 is mounted on the motor shaft of the motor 122.

On the other hand, in the fourth variation, the openable cover 110 is provided with a pushing portion 110*b* projecting downward in FIG. 8A.

The pushing portion 110*b* pushes the movable portion 77 in a manner such that the unit drive gear 65 moves from the retracted position to the engageable position against the biasing force of the compression spring 78 (biasing member) in conjunction with the operation of closing the openable cover 110 in a state where the toner container 60 (detachable unit) is attached in the apparatus body 100 of the image forming apparatus 1000. The pushing portion 110*b* has a shape such that the width in the direction perpendicular to the opening or closing direction (the horizontal direction in FIG. 8A) gradually decreases from a root portion toward a tip portion of the pushing portion 110*b*.

Hereinafter, with reference to FIGS. 8A and 8B, an operation in attachment of the toner container 60 to the apparatus body 100 of the image forming apparatus 1000 in the fourth variation is described.

First, the openable cover 110 (see FIG. 1) is rotated to an open position to expose the installation portion 111 (a portion where the toner container 60 is installed, see FIG. 1) of the apparatus body 100 of the image forming apparatus 1000 upward. As illustrated in FIG. 8A, the toner container 60 is set on the installation portion 111. At this time, as illustrated in FIG. 8A, the movable portion 77 of the toner container 60 is positioned on the left side by the biasing three of the compression spring 78, and the unit drive gear 65 is positioned at the retracted position.

As illustrated in FIG. 8B, when the openable cover 110 is closed, the pushing portion 110*b* pushes the movable portion 77 against the biasing force of the compression spring 78. Accordingly, the unit drive gear 65 moves to the engageable position and engages with the apparatus-body drive gear 123. In this way, the openable cover 110 is closed, and a series of attachment operations of the toner container 60 is completed.

On the other hand, when the toner container 60 is taken out from the apparatus body 100 of the image funning apparatus 1000, an operation reverse to the above-described attachment operation is performed.

In the image forming apparatus 1000 according to the fourth variation having the above-described configuration, the failure of the shallow engagement between the apparatus-body drive gear 123 of the apparatus body 100 of the image forming apparatus 1000 and the unit drive gear 65 of the toner container 60 (detachable unit) is also less likely to occur.

Fifth Variation

Figure 9A:
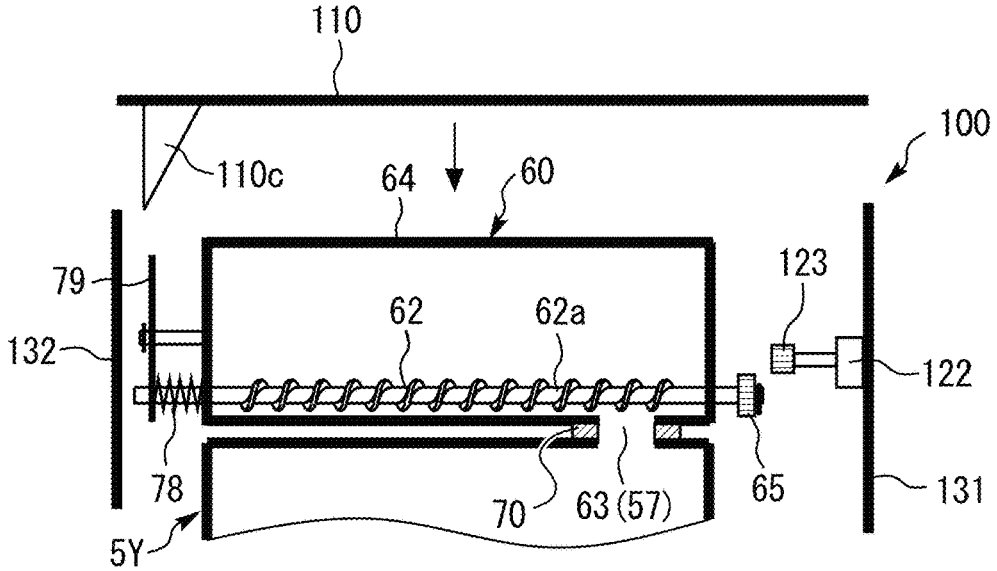
FIGS. 9A and 9B are diagrams illustrating an operation of closing an openable cover in an image forming apparatus according to a fifth variation.
Figure 9B:
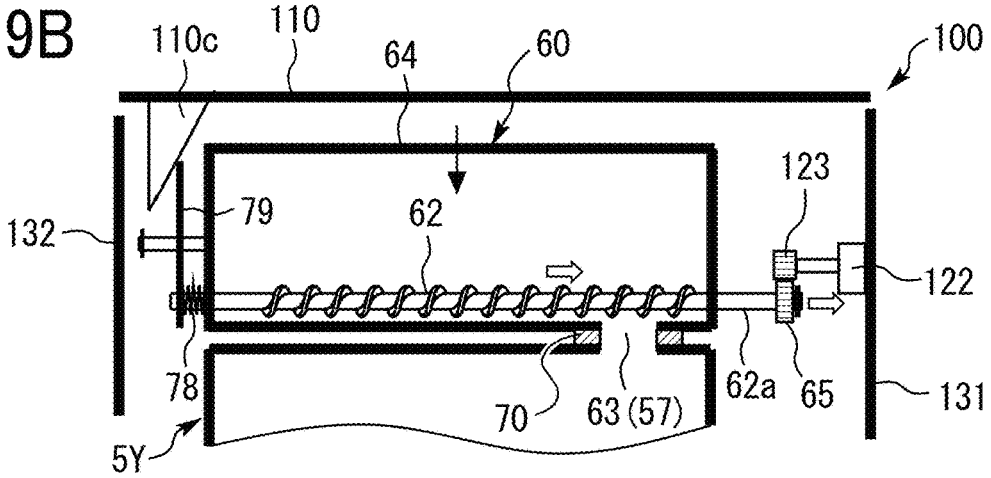

As illustrated in FIGS. 9A and 9B, in an image forming apparatus 1000 according to a fifth variation, similarly to the image forming apparatus 1000 according to the fourth variation, the unit drive gear 65 is configured to move in the axial direction in conjunction with the opening or closing operation of the openable cover 110.

However, in the fifth variation, a pushing portion 110*c* of the openable cover 110 and a movable portion 79 of the toner container 60 are disposed not on an end close to the unit drive gear 65 (one end portion in the rotation axis direction) but on the opposite end (the other end portion in the rotation axis direction).

In the image forming apparatus 1000 according to the fifth variation having the above-described configuration, the failure of the shallow engagement between the apparatus-body drive gear 123 of the apparatus body 100 of the image forming apparatus 1000 and the unit drive gear 65 of the toner container 60 (detachable unit) is also less likely to occur.

Fifth Variation

In an image forming apparatus 1000 according to a sixth variation, similarly to the image forming apparatus 1000 according to the fifth variation (or the first, second, or fourth variation), the unit drive gear 65 moves in the axial direction in conjunction with the operation of opening or closing the openable cover 110 (or the operation of attaching or detaching the toner container 60). Further, the toner conveying screw 62 as a rotary body moves along the rotation axis direction thereof in conjunction with the operation of moving the unit drive gear 65 between the engageable position and the retracted position along the axial direction.

In the sixth variation, the toner conveying screw 62 rotates when the toner conveying screw 62 (rotary body) moves along the rotation axis direction in conjunction with the movement of the unit drive gear 65 in the axial direction.

Figure 10A:
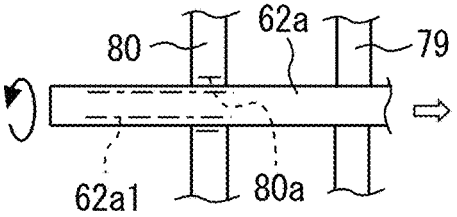
FIGS. 10A and 10B are diagrams illustrating an operation of a toner conveying screw in a toner container in an image forming apparatus according to a sixth variation.
Figure 10B:
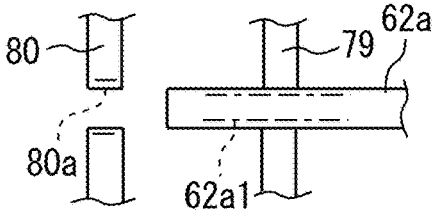

Specifically, as illustrated in FIGS. 10A and 10B, a side plate 80 on which a feed screw portion 80*a* is formed is secured to the toner container 60 at a distance from the movable portion 79 in the axial direction. On the other hand, a male screw portion 62*a*1 to be screwed into the feed screw portion 80*a* is formed in a part of the shaft portion 62*a* of the toner conveying screw 62.

With such a configuration, as illustrated in FIGS. 10A and 10B, when the toner conveying screw 62 moves in the rotation axis direction, the toner conveying screw 62 rotates due to the screw engagement between the feed screw portion 80*a* and the male screw portion 62*a*1.

With such a configuration, even if the toner in the toner container 60 before replacement is biased to one side in the longitudinal direction due to transportation or the like, the toner convoying screw 62 rotates while moving in the longitudinal direction (rotation axis direction) in conjunction with the operation of attaching the toner container 60 to the apparatus body 100 of the image forming apparatus 1000, and the biased toner is efficiently loosened.

Experimental Results

Finally, an experiment conducted b the present inventors is described.

In the experiment, the image forming apparatus 1000 described in each of the present embodiment and variations and an image forming apparatus according to a comparative example were prepared. As the comparative example, in the image forming apparatus 1000 described with reference to FIGS. 3A to 3C, springs for biasing the case 64 of the toner container 60 downward are installed in the openable cover 110. In each image forming apparatus, printing with an image area ratio of 5% was performed on 3000 sheets P having an A4 size, and the presence or absence of abnormal noise due to poor engagement between the apparatus-body drive gear 123 and the unit drive gear 65 was determined.

As a result, the occurrence of abnormal noise was confirmed in the comparative example, whereas the occurrence of abnormal noise was not confirmed in the present embodiment and variations.

In addition, the operability of the openable cover 110 was functionally evaluated for each of the present embodiment and variations and the comparative example. As a result, the operability of the openable cover 110 was not good in the case of the comparative example, whereas the operability of the openable cover 110 was good in the cases of the present embodiment and variations.

As described above, the image forming apparatus includes according to the present embodiment, the toner container 60 (detachable unit) that is attached to and detached from the apparatus body 100 of the image forming apparatus 1000 in predetermined attachment and detachment directions. The toner container 60 is provided with a rotatable toner conveying screw 62 (rotary body) and a unit drive gear 65 that transmits drive to the toner conveying screw 62. The apparatus body 100 of the image forming apparatus 1000 is provided with the apparatus-body drive gear 123. The apparatus-body drive gear 1 engages with the unit drive gear 65 of the toner container 60, which is attached to the apparatus body 100 of the image forming apparatus 1000, at the engageable position on the downstream side in the attachment direction. When the toner container 60 is attached to or detached from the apparatus body 100 of the image forming apparatus 1000, at least one of the unit drive gear 65 and the apparatus-body drive gear 123 moves to the retracted position where the at least one of the unit drive gear 65 and the apparatus-body drive gear 123 does not engage with the other gear and does not interfere with the attachment or detachment operation of the toner container 60 to or from the apparatus body 100 of the image forming apparatus 1000.

Such a configuration can reduce the failure of the shallow engagement between the apparatus-body drive gear 123 of the apparatus body 100 of the image forming apparatus 1000 and the unit drive gear 65 of the toner container 60.

Note that, in the present embodiment (including variations thereof, which is the same hereinafter), the image forming apparatus 1000 includes the process cartridge 6Y in which the photoconductor drum 1Y (image bearer), the developing device 5Y, the charging device 4Y, and the cleaning device 2Y are integrated. However, embodiments of the present invention are not limited to such a configuration and all or a part of the process cartridge 6Y, the cleaning device 2Y the charging device 4Y, and the developing device 5Y may be configured as a unit that is individually attached to and detached from the apparatus body 100 of the image forming apparatus 1000. Even in such a case, an advantageous effect equivalent to the present embodiment can be obtained.

Note that the term "process cartridge" used in the present disclosure means a detachable unit including an image bearer and at least one of a changing device to charge the image bearer, a developing device to develop a latent image on the image bearer, and a cleaning device to clean the image bearer that are united together, and is removably attached as a single unit in the apparatus body of the image forming apparatus.

Further, in the image forming apparatus 1000 according to the present embodiment, the toner container 60 is directly connected to the developing device 5Y. Alternatively, for example, in an image forming apparatus according to an embodiment, a toner container may be indirectly connected to a developing device via, for example, a sub hopper/

In addition, in the present embodiment, the motor 122 in which the apparatus-body drive gear 123 is installed on the motor shaft is installed on the movable portion 120. Alternatively, in some embodiments, for example, only an apparatus-body drive gear may be rotatably installed in a movable portion without installing a motor on the movable portion. In such a case, the drive of a motor installed at another location is transmitted to the apparatus-body drive gear via a gear train.

In the present embodiment, only one of the unit drive gear 65 and the apparatus-body drive gear 123 moves between the retracted position and the engageable position. However, in some embodiments, each of the unit drive gear 65 and the apparatus-body drive gear 123 may be configured to move between the retracted position and the engageable position.

Further, in the present embodiment, the image forming apparatus 1000 is a color image forming apparatus. However, in some embodiments, the image forming apparatus may be a monochrome image forming apparatus.

In the present embodiment, the image forming apparatus 1000 is an electrophotographic image forming apparatus. However, embodiments of the present invention are not limited to the electrophotographic image forming apparatus. In some embodiment, for example, the image forming apparatus may be an image forming apparatus of another system (for example, an image forming apparatus of an inkjet system or a stencil printer).

Further, in the image forming apparatus 1000 according to the present embodiment, the toner containers 60 as the detachable units are installed. However, embodiments of the present invention are not limited to such a configuration of the detachable units. In some embodiment, for example, the detachable unit may be a detachable unit such as the process cartridge 6Y or the fixing device 20 as long as the detachable unit includes a rotary body.

Further, in the image forming apparatus according to the present embodiment, the toner container 60 serving as the detachable unit is attached and detached in the vertical direction. However, embodiments of the present invention are not limited to the vertical direction. In some embodiments, for example, the image forming apparatus may include the detachable unit that is horizontally attached to and detached from an apparatus body of the image forming apparatus.

Even in such a case, an advantageous effect equivalent to that of the present embodiment can be obtained.

Note that embodiments of the present invention are not limited to the above-described embodiments and it is apparent that the above-described embodiments can be appropriately modified within the scope of the technical idea of the present disclosure in addition to what is suggested in the above-described embodiments. Further, the number, position, shape, and so forth of components are not limited to those of the present embodiment and variations, and may be the number, position, shape, and so forth that are suitable for implementing the present disclosure.

The invention claimed is:

1. An image forming apparatus, comprising:

an apparatus body; and a detachable unit attachable to the apparatus body in an attachment direction and detachable from the apparatus body in a detachment direction, the detachable unit including:

a rotary body; and a unit drive gear to transmit a driving force to the rotary body, wherein the apparatus body includes an apparatus-body drive gear to engage with the unit drive gear of the detachable unit attached in the apparatus body, at an engageable position on a downstream side of the apparatus-body drive gear in the attachment direction, and wherein one or each of the unit drive gear and the apparatus-body drive gear is movable to a retracted position at which the one or each of the unit drive gear and the apparatus-body drive gear does not engage with the other of the unit drive gear and the apparatus-body drive gear and does not interfere with an attachment operation and a detachment operation of the detachable unit with respect to the apparatus body.

2. The image forming apparatus according to claim 1, wherein the one or each of the unit drive gear and the apparatus-body drive gear is to move from the engageable position to the retracted position and back to the engageable position in conjunction with the attachment operation and the detachment operation of the detachable unit with respect to the apparatus body.

3. The image forming apparatus according to claim 2, wherein the apparatus body or the detachable unit includes:

a movable portion holding one of the apparatus-body drive gear and the unit drive gear so as to be movable together with the one of the apparatus-body drive gear and the unit drive gear; and a biasing member biasing the movable portion in a manner such that the one of the apparatus-body drive gear and the unit drive gear is biased from the retracted position toward the engageable position, and wherein the apparatus body or the detachable unit includes a pushing portion to push the movable portion in a manner such that the one of the apparatus-body drive gear and the unit drive gear moves from the engageable position to the retracted position against a biasing force of the biasing member in conjunction with the attachment operation and the detachment operation of the detachable unit with respect to the apparatus body.

4. The image forming apparatus according to claim 3, wherein the apparatus body or the detachable unit includes an elastic member disposed between the apparatus body and the detachable unit.

5. The image forming apparatus according to claim 4, wherein the elastic member biases in a direction in which an inter-axis distance between the apparatus-body drive gear and the unit drive gear decreases.

6. The image forming apparatus according to claim 5, wherein the inter-axis distance between the apparatus-body drive gear and the unit drive gear is set to a distance at which tooth bottoms of the unit drive gear and the apparatus-body drive gear does not contact each other when the elastic member is not disposed.

7. The image forming apparatus according to claim 1, wherein the apparatus body includes an openable cover to open and close for the attachment operation and the detachment operation of the detachable unit with respect to the apparatus body, and wherein the one or each of the unit drive gear and the apparatus-body drive gear is to move from the retracted position to the engageable position in conjunction with an operation of closing the openable cover and moves from the engageable position to the retracted position in conjunction with an operation of opening the openable cover in a state in which the detachable unit is attached in the apparatus body.

8. The image forming apparatus according to claim 7, wherein the apparatus body or the detachable unit includes:

a movable portion holding one of the apparatus-body drive gear and the unit drive gear so as to be movable together with the one of the apparatus-body drive gear and the unit drive gear; and a biasing member biasing the movable portion in a manner such that the one of the apparatus-body drive gear and the unit drive gear is biased from the engageable position toward the retracted position, and wherein the openable cover includes a pushing portion to push the movable portion in a manner such that the one of the apparatus-body drive gear and the unit drive gear moves from the retracted position to the engageable position against a biasing force of the biasing member in conjunction with an operation of closing the openable cover in the state in which the detachable unit is attached in the apparatus body.

9. The image forming apparatus according to claim 1, wherein the one or each of the unit drive gear and the apparatus-body drive gear is to move between the engageable position and the retracted position along an axial direction of the one or each of the unit drive gear and the apparatus-body drive gear.

10. The image forming apparatus according to claim 1, wherein the rotary body is to move along a rotation axis direction of the rotary body in conjunction with an operation of the unit drive gear moving between the engageable position and the retracted position along an axial direction of the unit drive gear.

11. The image forming apparatus according to claim 10, wherein the rotary body is to rotate when the rotary body moves along the rotation axis direction in conjunction with the operation of the unit drive gear moving between the engageable position and the retracted position along the axial direction.

12. The image forming apparatus according to claim 1, wherein when the driving force is transmitted from the apparatus-body drive gear to the unit drive gear, a force received by the unit drive gear from the apparatus-body drive gear acts in a direction in which the detachable unit is biased to an upstream side in the attachment direction.

13. The image forming apparatus according to claim 1, further comprising a developing device disposed in the apparatus body, wherein the detachable unit is a toner container directly or indirectly connected to the developing device, wherein the rotary body is a toner conveying screw, and wherein each of the attachment direction and the detachment direction is a vertical direction.

14. The image forming apparatus according to claim 13, wherein the toner container includes a case to be installed to the apparatus body by an own weight of the case.

15. The image forming apparatus according to claim 1, wherein the one or each of the unit drive gear and the apparatus-body drive gear is to move to the retracted position in a direction orthogonal to the attachment direction.

* * * * *